US010208927B2

(12) United States Patent
Brunt, Jr.

(10) Patent No.: US 10,208,927 B2
(45) Date of Patent: Feb. 19, 2019

(54) CONTROL OF LIGHT UNIFORMITY USING FRESNEL FIELD PLACEMENT OF OPTICAL ELEMENTS

(71) Applicant: LumenFlow Corp., Wyoming, MI (US)

(72) Inventor: Harold W. Brunt, Jr., Grand Rapids, MI (US)

(73) Assignee: Lumenflow Corp., Wyoming, MI (US)

( * ) Notice: Subject to any disclaimer, the term of this patent is extended or adjusted under 35 U.S.C. 154(b) by 214 days.

(21) Appl. No.: 15/444,969

(22) Filed: Feb. 28, 2017

(65) Prior Publication Data

US 2017/0254490 A1 Sep. 7, 2017

Related U.S. Application Data

(60) Provisional application No. 62/301,764, filed on Mar. 1, 2016.

(51) Int. Cl.

| | |
|---|---|
| ***F21V 17/00*** | (2006.01) |
| ***F21V 5/00*** | (2018.01) |
| ***F21V 19/00*** | (2006.01) |
| ***F21S 8/02*** | (2006.01) |
| ***F21V 5/04*** | (2006.01) |
| *F21Y 115/10* | (2016.01) |
| *F21Y 105/10* | (2016.01) |

(52) U.S. Cl.

CPC ..... *F21V 17/002* (2013.01); *F21S 8/02* (2013.01); *F21V 5/007* (2013.01); *F21V 5/04* (2013.01); *F21V 19/0035* (2013.01); *F21Y 2105/10* (2016.08); *F21Y 2115/10* (2016.08)

(58) Field of Classification Search

CPC . F21V 17/002; F21V 5/04; F21V 5/00; F21V 19/0035; F21S 8/02; F21Y 2105/10; F21Y 2115/01

See application file for complete search history.

(56) References Cited

U.S. PATENT DOCUMENTS

| | | | | |
|---|---|---|---|---|
| 8,045,175 | B2 | 10/2011 | de Groot et al. | |
| 8,125,713 | B2 | 2/2012 | Gluckstad | |
| 2017/0254490 | A1 * | 9/2017 | Brunt, Jr. ..... | F21S 8/02 |

OTHER PUBLICATIONS

Jefferson et al, "Aspheric Laser Beam Reshaper Application Guide," IBM Almaden Research Center, <http://assets.newport.com/webDocuments-EN/images/11976.PDF>, accessed Nov. 16, 2015.
Allen et al, "A Nearly Ideal Phosphor-Converted White Light-Emitting Diode," Applied Physics Letters 92 (2008).
Shealy et al, "Beam Shaping Profiles and Propagation," Applied Optics, vol. 45, Issue 21 (2006).

* cited by examiner

*Primary Examiner* — David V Bruce
(74) *Attorney, Agent, or Firm* — Warner Norcross + Judd LLP

(57) ABSTRACT

An optical emitter providing improved light uniformity. The optical emitter includes a light source and a lens element spaced apart from the light source such that no additional lens elements are positioned therebetween. The lens element includes an inner light-receiving surface within the Fresnel field of the light source. In some embodiments, the light source includes an LED array and the lens element includes a lens array. The optical emitter provides the ability to adjust focus or spot size while not degrading the uniformity of the light intensity.

20 Claims, 4 Drawing Sheets

CONTROL OF LIGHT UNIFORMITY USING FRESNEL FIELD PLACEMENT OF OPTICAL ELEMENTS

FIELD OF THE INVENTION

The present invention relates to optical emitters having LEDs that provide improved light intensity uniformity across the illuminated area.

BACKGROUND OF THE INVENTION

LEDs are semiconductor devices that emit light when a voltage is applied. LEDs are increasingly preferred over fluorescent lighting and incandescent lighting. For example, LEDs benefit from a longer life and a higher efficiency, and are in many instances less expensive to manufacture. LEDs have been employed in a variety of applications, including indoor lighting, outdoor lighting, and vehicle lighting.

Despite these advantages, it can be desirable to provide improved uniformity in the output of LED light. In particular, optical emitters that employ LEDs often lack satisfactory light output uniformity, or may require expensive modifications to achieve a satisfactory light output uniformity. It would be beneficial to provide an improved optical emitter which generates a more uniform light distribution across the illuminated area. In particular, it would be beneficial to provide an optical emitter having improved control of light uniformity without unduly adding expense or complexity.

SUMMARY OF THE INVENTION

An improved optical emitter is provided. The optical emitter includes a light source and a lens element spaced apart from the light source such that no additional lens elements are positioned therebetween. The lens element includes an inner light-receiving surface within the Fresnel field of the light source to provide a light intensity output that is substantially uniform across an illuminated area.

In one embodiment, the light source is an LED having a diameter D and emitting light with emission wavelength W. The lens element is opposite of the LED to define an uninterrupted light path therebetween. The inner light-receiving surface of the lens element is within the LED's Fresnel field, the Fresnel field including a lower limit $R_1$ of $$0.62\times\sqrt{\frac{D^3}{W}}$$

and an upper limit $R_2$ of $$2\times\frac{D^2}{W},$$

such that the light intensity from the center of the illuminated area to the edge of the illuminated area is substantially uniform.

In another embodiment, the optical emitter includes an array of LEDs each defining a diameter D and with emission wavelength W between 390 nm and 700 nm, inclusive. The optical emitter includes a corresponding array of lens elements that are positioned opposite of the array of LEDs. The lens elements include an inner light-receiving surface within the Fresnel field of the LEDs, such that the light intensity across the illuminated area from the array of LEDs is substantially uniform. The lens elements can be interconnected by a flange portion to define a one-piece lens array. The LEDs can be mounted to a circuit board within an annular housing, or can be individually mounted to submounts which are then mounted to a circuit board within an annular housing.

The embodiments of the present invention can provide a uniform spot of light for general downlighting applications, such that the light intensity varies by only several percent. By placing the light-receiving surface of the lens element within the Fresnel field, the control and the distribution of light is greatly improved, also providing the ability to adjust other optical elements for a variable focus or spot size while not degrading the uniformity of the light intensity while adjusted.

These and other advantages and features of the invention will be more fully understood and appreciated by reference to the drawings and the description of the current embodiments.

DESCRIPTION OF THE CURRENT EMBODIMENTS

The invention as contemplated and disclosed herein includes an optical emitter for providing an improved light intensity output. As set forth below, the optical emitter includes a light source and a lens element having an inner light-receiving surface within the Fresnel field of the light source. The optical emitter can provide improved control and distribution of light for general applications, optionally as a downlight.

Figure 1:
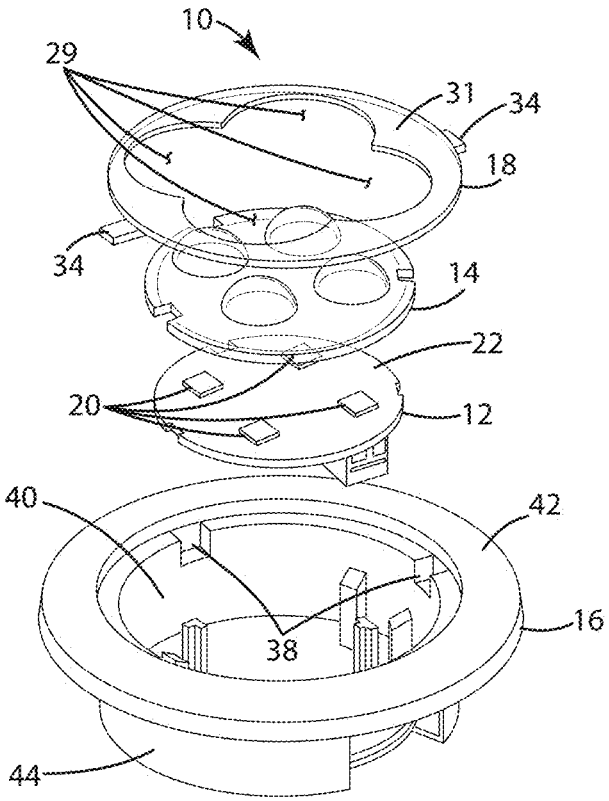
FIG. 1 is a perspective view of an optical emitter including an LED array, a lens array, and a stabilizing ring in accordance with one embodiment.

An optical emitter in accordance with one embodiment is depicted in FIG. 1 and generally designated 10. The optical emitter 10 includes an LED array 12, a lens array 14, a housing 16, and a stabilizing ring 18. The LED array 12 includes a plurality of LEDs 20 (or other light sources, whether now known or hereinafter developed) that are directly or indirectly mounted to a substrate 22. For example, the plurality of LEDs can be disposed directly onto a common substrate or circuit board as generally shown in FIG. 1. Further by example, the plurality of LEDs 20 can each be disposed on a submount, which are then mounted to a common substrate or circuit board. Four LEDs are shown in the present embodiment, but greater or fewer number of LEDs can be implemented in other embodiments, including for example a single LED.

Figure 2:
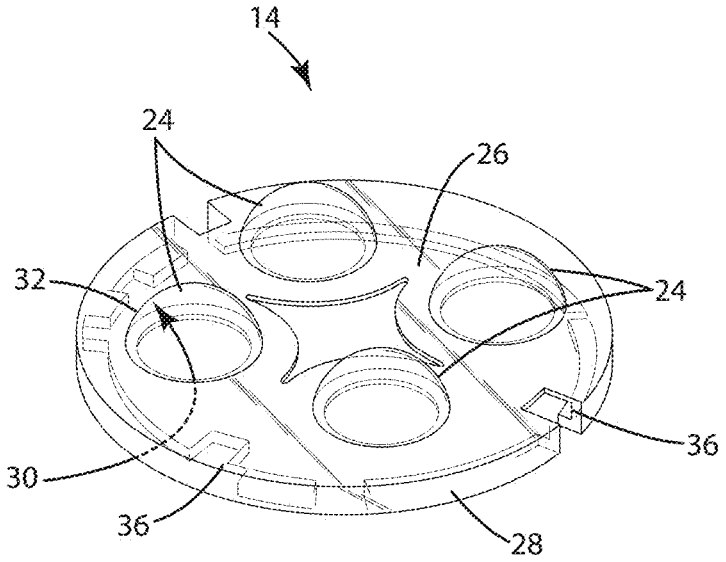
FIG. 2 is a perspective view of the lens array of FIG. 1.

As noted above, the optical emitter 10 also includes a lens array 14. The lens array 14 includes one or more lens elements 24 positioned above the one or more LEDs, such that an uninterrupted light path or cavity exists between each LED and its corresponding lens element. In the illustrated embodiment, the lens array 14 is a one-piece molded member having four lens elements 24 interconnected by a flange portion 26. The flange portion 26 is a projecting flat rim that joins the individual lens elements 24 together. The flange portion 26 also includes an annular perimeter 28 extending around each of the lens elements 24, such that each lens element 24 is entirely contained within the flange portion 26. The lens elements 24 can include any construction to refract light from the LEDs. The lens elements 24 are negative meniscus lenses in the present embodiment as shown in FIG. 2, but can include other constructions in other embodiments, for example a double convex lens, a double concave lens, a positive meniscus lens, a plano-concave lens, a plano-convex lens, or a hemispherical lens.

Figure 3:
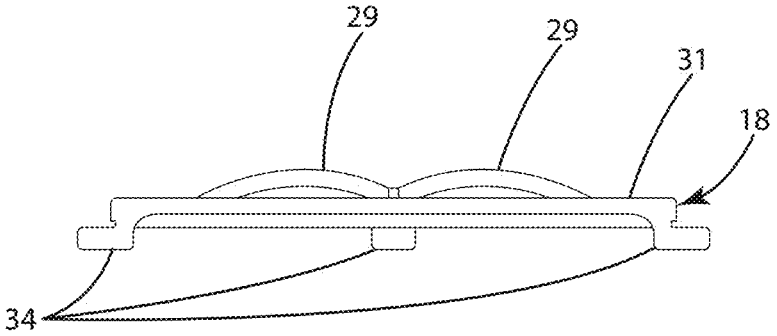
FIG. 3 is a side elevation view of the stabilizing ring of FIG. 1.
Figure 4:
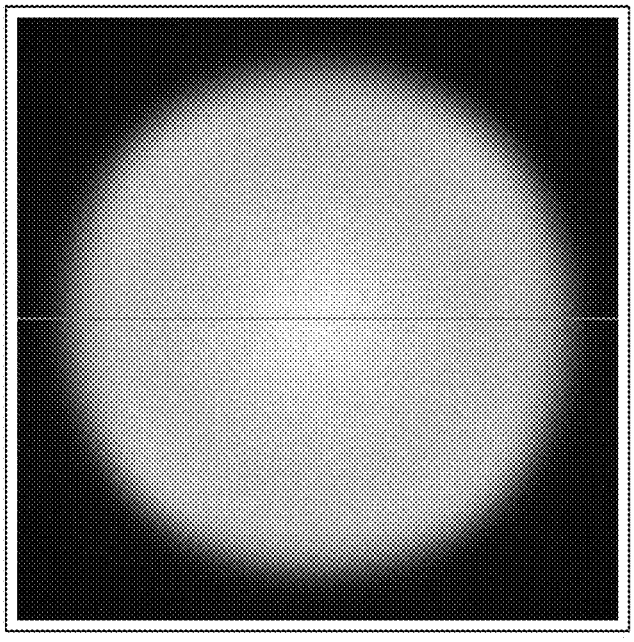
FIG. 4 is a first optical image using the optical emitter of FIG. 1.

As noted above, the optical emitter 10 also includes a stabilizing ring 18. The stabilizing ring 18 may include a lens element or a plurality of lens elements positioned on the surface of the stabilizing ring 18. The lens elements or the plurality of lens elements can permit adjustment of the light path between the lens array 14 and the stabilizing ring 18. In the illustrated embodiment, the stabilizing ring 18 is a one-piece molded member having four lens elements 29 connected by a mounting flange 31. Adjusting the light path may be achieved by one of two methods. The first method includes moving the stabilizing ring 18 along the Z-axis (up or down) in relation to the lens array 14. The second method includes creating a new stabilizing ring 18' which possesses a different set of four lens elements 29', such that the different set of four lens elements 29' change the optical path performance while holding the same mechanical footprint within the optical emitter 10. The lens elements 29 can include any construction to refract light from the lens array 14. The lens elements 29 are meniscus lenses in the present embodiment as shown in FIG. 3, but can include other constructions in other embodiments, for example a double convex lens, a double concave lens, a positive meniscus lens, a plano-concave lens, a plano-convex lens, or a hemispherical lens.

As noted above, each lens element 24 of the lens array 14 is spaced apart from its corresponding LED 20. As shown in FIG. 2, each lens element 24 includes an inner light-receiving surface 30 and an outer light-transmitting surface 32 defining a thickness therebetween. Each lens element 24 refracts light received at the inner light-receiving surface 30. The inner light-receiving surface 30 is positioned within the "Fresnel field" of the underlying LED 20. As recited herein, the Fresnel field of an LED includes a lower limit $R_1$ of $$0.62\times\sqrt{\frac{D^3}{W}}$$

and an upper limit $R_2$ of $$2\times\frac{D^2}{W},$$

where D is the diameter of the LED (in a mm, as measured across the widest portion of the surface of the LED facing the lens element) and W is the primary emission wavelength of the LED (in mm), with $R_1$ and $R_2$ being in microns. In one example, an LED with a surface area of 1 $mm^2$ (D being 1.414 mm) and a primary emission wavelength of 0.5 microns (W being 0.0005 mm), the Fresnel field is between about 46 microns ($R_1$) and about 7000 microns ($R_2$). In this example, 46 microns represents the near field limit and 7000 microns represents the far field limit, with the Fresnel field being between these values. In this example, the inner light-receiving surface 30 is positioned between 0.046 mm and 7 mm from the light emitting surface of the LED 20. The LED in this example includes a primary emission wavelength of 0.5 microns, but can include other primary emission wavelengths in other embodiments, including wavelengths between 0.390 microns and 0.7 microns, inclusive.

As also shown in FIG. 1, the stabilizing ring 18 extends over the lens array 14. The stabilizing ring 18 includes a plurality of tabs 34 that are arranged to be received within a corresponding plurality of slots 36 in the lens array 14 and a corresponding plurality of slots 38 in the housing 16 (shown in FIG. 1). The housing 16 includes a recessed opening 40 for receipt of the LED array 12, the lens array 14, and the stabilizing ring 18 therein. The housing 16 includes an outer annular lip 42 and an cylindrical sidewall 44 in the illustrated embodiment, but can include other configurations in other embodiments as desired.

Though illustrated as including four LEDs, the optical emitter 10 can be modified to include a greater or fewer number of LEDs. For example, the LED array 12 can include a single LED 20 and the lens array 14 can include a single lens element 24. In this embodiment, the inner light-receiving surface 30 of the single lens element 24, and optionally the outer light-transmitting surface 32 of the single lens element 24, is positioned within the Fresnel field of the LED 20. For an LED having a diameter of 1.414 mm and a primary emission wavelength of 0.5 microns, the Fresnel field can be between about 0.046 mm and 7 mm above the light emitting surface of the LED 20 to provide improved control and distribution of light across an illuminated area.

Figure 5:
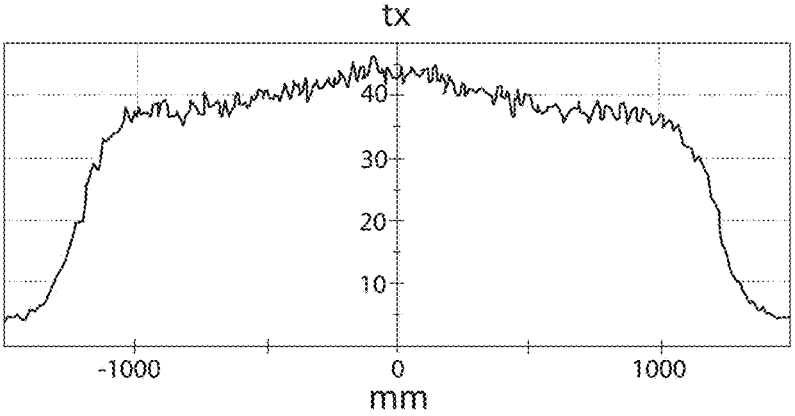
FIG. 5 is an intensity model of the light output of FIG. 4.
Figure 6:
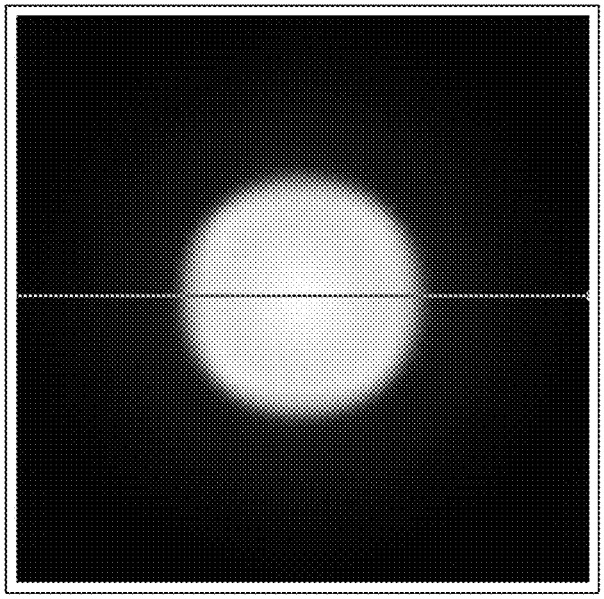
FIG. 6 is a second optical image using the optical emitter of FIG. 1.
Figure 7:
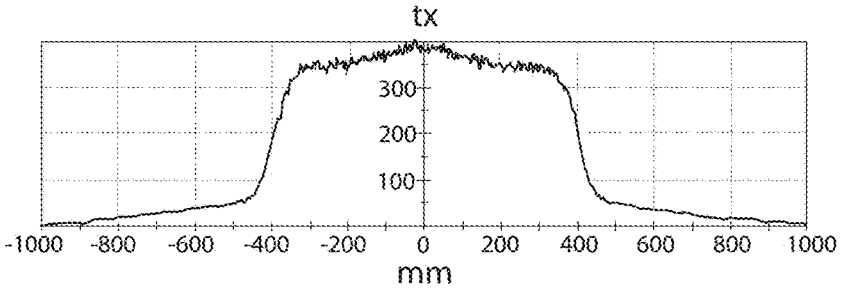
FIG. 7 is an intensity model of the light output of FIG. 6.

FIGS. 4-7 illustrate the substantially uniform light intensity distribution for the optical emitter of the present embodiments. As used herein, light intensity is "substantially uniform" when the intensity varies by less than several percent. The optical emitter 10 provides the ability to adjust focus or spot size while not degrading the uniformity of the light field. This is accomplished by adjusting the Z-axis position of the stabilizing ring 18, or by replacing the stabilizing ring 18 with a different stabilizing ring 18'. For example, the spot size differs between FIG. 4 and FIG. 6, however the light intensity is substantially uniform in both examples as shown in FIG. 5 and FIG. 7, respectively. Further advantages include the freedom from degradation of the light field (high Lateral Chromatic Separation) while outer elements are adjusted and freedom from the use of internal or external aperture structures.

The above descriptions are those of current embodiments of the invention. Various alterations and changes can be made without departing from the spirit and broader aspects of the invention as set forth in the following claims, which are to be interpreted in accordance with the principles of patent law including the Doctrine of Equivalents.

The invention claimed is:

1. An optical emitter comprising:

an LED array including a plurality of LEDs defining a diameter D and a primary emission wavelength W between 390 nm and 700 nm, inclusive;

a lens array including a first plurality of lens elements that are positioned opposite the plurality of LEDs to define an uninterrupted light path therebetween, the first plurality of lens elements each defining an inner light-receiving surface; and a stabilizing ring including a second plurality of lens elements that are positioned opposite the lens array to define an adjustable light path therebetween;

wherein the inner light-receiving surface of the first plurality of lens elements are within the Fresnel field of the plurality of LEDs such that the intensity of light distributed across an illuminated area is substantially uniform, the Fresnel field including a lower limit $R_1$ of $$0.62\times\sqrt{\frac{D^3}{W}}$$

and including an upper limit $R_2$ of $$2\times\frac{D^2}{W}.$$

2. The optical emitter of claim 1 wherein the lens array is a one-piece element including a flange portion to interconnect the first plurality of lens elements.

3. The optical emitter of claim 1 wherein the first plurality of lens elements are equidistant from a centerline axis defined by the optical emitter.

4. The optical emitter of claim 1 wherein the plurality of LEDs are directly or indirectly mounted to a common substrate.

5. The optical emitter of claim 1 wherein the plurality of LEDs are equidistant from a centerline axis defined by the optical emitter.

6. The optical emitter of claim 1 further including an optical emitter housing to receive the LED array, the lens array, and the stabilizing ring therein.

7. The optical emitter of claim 6 wherein the LED array and the lens array are seated within an annular recess in the optical emitter housing.

8. An optical emitter comprising:

a light emitting element defining a diameter D and operable to emit light having primary emission wavelength W; and an optical element spaced apart from the light emitting element such that no additional optical elements exist therebetween, the optical element including a light-receiving surface, wherein the light-receiving surfaces of the optical element is within the Fresnel field of the light emitting device such that the intensity of light distributed across the optical element is substantially uniform, the Fresnel field including a lower limit $R_1$ of $$0.62\times\sqrt{\frac{D^3}{W}}$$

and including an upper limit $R_2$ of $$2\times\frac{D^2}{W}.$$

9. The optical emitter of claim 8 wherein the light emitting element is a light emitting diode.

10. The optical emitter of claim 8 wherein the light emitting element defines a centerline axis that extends through a geometric center of the optical element.

11. The optical emitter of claim 8 wherein the light emitting element provides a non-collimated light output.

12. The optical emitter of claim 8 wherein the primary emission wavelength W of the light emitting element is between 390 nm and 700 nm, inclusive.

13. The optical emitter of claim 8 wherein the optical element is a lens, a filter, or a reflector.

14. The optical emitter of claim 8 wherein the light intensity from a center of the optical element to a lateral edge of optical element varies by less than ten percent.

15. An optical emitter comprising:

an LED array including a plurality of co-planar LEDs each defining a diameter D and a primary emission wavelength W between 390 nm and 700 nm, inclusive;

a lens array including a first plurality of lens elements that are positioned opposite the plurality of LEDs to define an uninterrupted light path therebetween, the first plurality of lens elements each defining an inner light-receiving surface; and a stabilizing ring including a second plurality of lens elements that are positioned opposite the lens array to define an adjustable light path therebetween, the stabilizing ring being movable in a direction orthogonal to a plane defined by the co-planar LEDs to control the focus of the LED array;

wherein the inner light-receiving surface of the first plurality of lens elements are within the Fresnel field of the plurality of LEDs such that the intensity of light distributed across an illuminated area is substantially uniform irrespective of the distance of the stabilizing ring relative to the LED array, the Fresnel field including a lower limit $R_1$ of $$0.62\times\sqrt{\frac{D^3}{W}}$$

and including an upper limit $R_2$ of $$2\times\frac{D^2}{W}.$$

16. The optical emitter of claim 15 wherein the lens array is a one-piece element including a flange portion to interconnect the first plurality of lens elements.

17. The optical emitter of claim 15 wherein the first plurality of lens elements are equidistant from a centerline axis defined by the optical emitter.

18. The optical emitter of claim 15 wherein the plurality of LEDs are equidistant from a centerline axis defined by the optical emitter.

19. The optical emitter of claim 15 further including an optical emitter housing to receive the LED array, the lens array, and the stabilizing ring therein.

20. The optical emitter of claim 19 wherein the LED array and the lens array are seated within an annular recess in the optical emitter housing.

* * * * *